US005379582A

United States Patent [19]

Inoue et al.

[11] Patent Number: 5,379,582

[45] Date of Patent: Jan. 10, 1995

[54] BALLOON CONTROLLER FOR A SPINNING NOZZLE

[75] Inventors: Yoshihisa Inoue, Ibaraki; Koichi Doi, Kyoto; Hiroshige Maruki, Kusatsu; Teruo Nakayama, Ohtsu, all of Japan

[73] Assignee: Murata Kikai Kabushiki Kaisha, Kyoto, Japan

[21] Appl. No.: 224,996

[22] Filed: Apr. 4, 1994

Related U.S. Application Data

[63] Continuation of Ser. No. 905,830, Jun. 29, 1992, abandoned.

[30] Foreign Application Priority Data

Jul. 1, 1991 [JP] Japan ..... 3-058869[U]

[51] Int. Cl.[6] ..... D01H 5/28; D01H 1/115

[52] U.S. Cl. ..... 57/333; 57/350; 57/354

[58] Field of Search ..... 57/332, 328, 341, 342, 57/343, 344, 350, 333, 352, 354

[56] References Cited

U.S. PATENT DOCUMENTS

| | | | |
|---|---|---|---|
| 4,112,658 | 9/1978 | Morihashi | 57/328 |
| 4,437,302 | 3/1984 | Anamara et al. | 57/333 |
| 4,457,130 | 7/1984 | Sakai et al. | 57/328 |
| 4,509,321 | 4/1985 | Kajita et al. | 57/328 |
| 4,569,193 | 2/1986 | Anahara et al. | 57/350 X |
| 4,642,978 | 2/1987 | Noda | 57/328 |
| 4,689,948 | 9/1987 | Banov et al. | 57/350 X |

*Primary Examiner*—Daniel P. Stodola
*Assistant Examiner*—William Stryjewski
*Attorney, Agent, or Firm*—Spensley Horn Jubas & Lubitz

[57] ABSTRACT

A spinning nozzle comprises first and second nozzles provided with jetting holes through which compressed air is jetted into tubular yarn passages extending along an imaginary center line of the spinning nozzle, and arranged in series coaxially with the imaginary center line, and the second nozzle is provided in its outlet end with a balloon controller having a through hole having substantially a triangular cross section. The size of the balloon is limited to that of a circle inscribed in the through hole of the balloon controller, so that twists inserted in the yarn in the second nozzle propagate stably to a portion of the yarn in the first nozzle.

3 Claims, 1 Drawing Sheet

BALLOON CONTROLLER FOR A SPINNING NOZZLE

This is a continuation of application Ser. No. 07/905,830 filed on Jun. 29, 1992, now abandoned.

BACKGROUND OF THE INVENTION

1. Field of the Invention

The present invention relates generally to a spinning nozzle, and more specifically to a nozzle for applying twists inherent in a bundled spun yarn to a fiber bundle drafted by a pneumatic spinning apparatus.

2. Related Art Statement

In a pneumatic spinning apparatus, a fiber bundle drafted and supplied from front rollers of a drafting device is twisted by a spinning nozzle comprising a first nozzle and a second nozzle arranged in a line along a passage of the fiber bundle. A tubular yarn passage provided with jetting holes for jetting compressed air toward the fiber bundle is formed in the first nozzle. A tubular yarn passage is also formed in the second nozzle and is provided with jetting holes for jetting compressed air into the tubular passage to produce swirling air current swirling in an opposite direction to the swirling air current produced in the first nozzle.

The second nozzle is provided in its outlet end portion with a balloon controller having a through hole of a diameter smaller than the diameter of the tubular yarn passage.

The conventional balloon controller 12 of the second nozzle 2 is cylindrical and the through hole 13 has a circular cross section as shown in FIG. 4.

The balloon controller 12 limits the diameter of the balloon of the false-twisted fiber bundle indicated by alternate long and short dash line Ba in FIG. 4 so that the twists inserted in the fiber bundle in the second nozzle 2 propagate stably to a portion of the fiber bundle in the first nozzle 1. Accordingly, it is desirable that the through hole 13 has the smallest possible diameter. However, if the diameter of the through hole 13 is excessively small relative to the yarn count, the air blown into the tubular yarn passage of the second nozzle cannot be discharged from the second nozzle, which makes the spinning operation impossible.

OBJECT AND SUMMARY OF THE INVENTION

It is an object of the present invention to provide a spinning nozzle having a second nozzle provided with a balloon controller capable of restricting the diameter of the balloon to a small value and of smoothly discharging the air jetted into the second nozzle.

The present device provides a spinning nozzle comprising first and second nozzles provided with jetting holes through which compressed air is jetted into tubular yarn passages extending along an imaginary center line of the spinning nozzle, and arranged in series coaxially with the imaginary center line, wherein the second nozzle is provided in its outlet end with a balloon controller having a through hole having substantially a triangular cross section.

The through hole restricts the diameter of the balloon of the yarn to a small value and enables the air jetted into the second nozzle to be discharged smoothly.

DETAILED DESCRIPTION OF PREFERRED EMBODIMENT

A spinning nozzle embodying the present device will be described with reference to the accompanying drawings.

Figure 3:
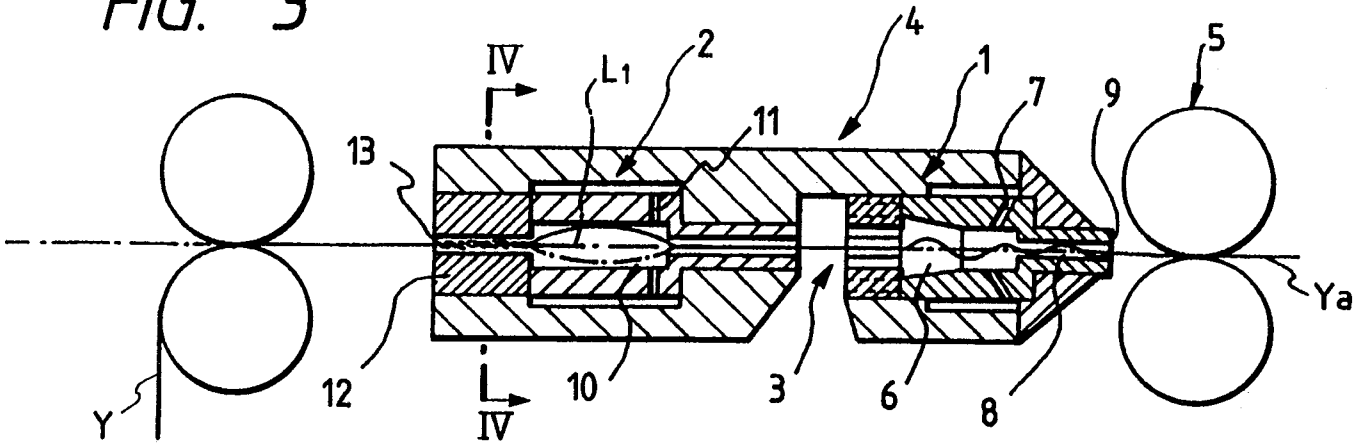
FIG. 3 is a longitudinal sectional view of a spinning nozzle.

Referring to FIG. 3, in a pneumatic spinning apparatus, a fiber bundle Ya delivered from front rollers 5 of a drafting unit is twisted by a spinning nozzle 4 formed by combining a first nozzle 1 and a second nozzle 2 in a series arrangement with a small gap 3 therebetween. Swirling air currents flowing in opposite directions are produced respectively in the first nozzle 1 and the second nozzle 2 to twist the fiber bundle Ya. A tubular yarn passage 6 is formed in the first nozzle 1 and the first nozzle 1 is provided with jetting holes 7 inclined to the imaginary center line $L_1$ of the tubular yarn passage 6 and tangent to the tubular yarn passage 6. Compressed air is blown through the jetting holes 7 into the tubular yarn passage 6 to produce whirling suction air currents within the tubular yarns passage 6. Consequently, the fiber bundle Ya is sucked through the suction hole 9 of an inlet pipe 8 into the tubular yarn passage 6.

A tubular yarn passage 10 is formed in the second nozzle 2 and the second nozzle 2 is provided with jetting holes 11 tangent to the tubular yarn passage 10. False twists are applied to the fiber bundle Ya traveling through the tubular yarn passage 10 by jetting compressed air through the jetting holes 11 into the tubular yarn passage 10 to produce swirling air currents swirling in a direction opposite to that of the swirling air currents produced in the tubular yarn passage 6 of the first nozzle 1.

The false twists inserted in the fiber bundle Ya by the second nozzle 2 are transmitted to a portion of the fiber bundle Ya near the nip line of the front rollers 5, so that most fibers of the fiber bundle Ya are gathered together in a false-twisted fiber bundle immediately after leaving the nip line of the front rollers 5 and some fibers of the fiber bundle Ya remain free. The free fibers are wound around the false-twisted bundle in a direction opposite that of the false twists by the swirling air currents produced within the first nozzle 1 and swirling in a direction opposite to that of the false twists. The false twists are removed from the false-twisted fiber bundle immediately after the false-twisted fiber bundle has left the second nozzle 2 and, consequently, the fibers winding around the false-twisted fiber bundle wind firmly around the untwisted fiber bundle to form a yarn Y having parallel core fibers and winding fibers winding firmly around the parallel core fibers.

The second nozzle 2 is provided in its outlet end with a balloon controller 12 provided with a through hole 13 of a diameter smaller than the diameter of the tubular yarn passage 10.

Figure 1:
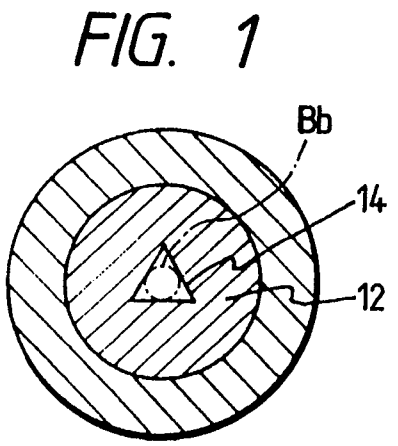
FIG. 1 is a sectional view of a balloon controller included in a spinning nozzle in a first embodiment according to the present invention.

In a spinning nozzle of the present invention, the firt nozzle 1 and the second nozzle 2 are connected in series coaxially with an imaginary center line $L_1$ and the second nozzle 2 is provided coaxially in its outlet end with a balloon controller 12 having a through hole 14 having a triangular cross section as shown in FIG. 1.

Referring to FIG. 3, when the spinning operation is started, a fiber bundle Ya delivered from the front rollers 5 of a drafting unit is passed through the first nozzle 1 and the small gap 3 between the first nozzle 1 and the second nozzle 2 into the second nozzle 2 by the action of whirling suction air currents produced in the first nozzle 1, the fiber bundle Ya is twisted in a false-twisted yarn by the twisting action of swirling air currents swirling within the second nozzle 2 in a direction opposite to the swirling direction of the swirling suction air currents produced in the first nozzle 1, and then the false twists are removed from the false-twisted yarn immediately after the false-twisted yarn has left the balloon controller 12 to produce a bundled spun yarn Y.

Since the cross section of the through hole 14 of the balloon controller 12 of the present device is triangular as shown in FIG. 1, the size of the balloon of the false-twisted fiber bundle Ya is limited to that of a circle inscribed in the through hole 14 having a regular triangle cross section as indicated by alternate long and short dash line Bb in FIG. 1, so that twists inserted in the fiber bundle Ya in the second nozzle 2 propagate stably to a portion of the fiber bundle Ya in the first nozzle 1. The air jetted into the second nozzle 2 is able to flow smoothly out of the second nozzle 2 through portions of the through hole 14 of the balloon controller 12 near the corners of the through hole 14 having a triangular cross section.

Figure 2:
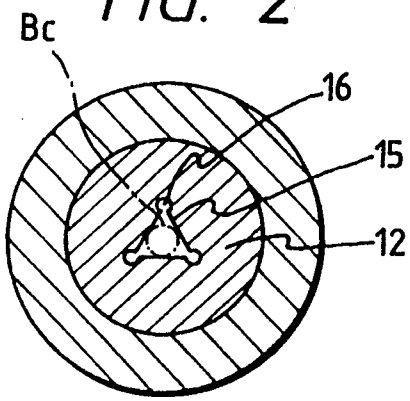
FIG. 2 is a sectional view of a balloon controller included in a spinning nozzle in a second embodiment according to the present invention.
Figure 4:
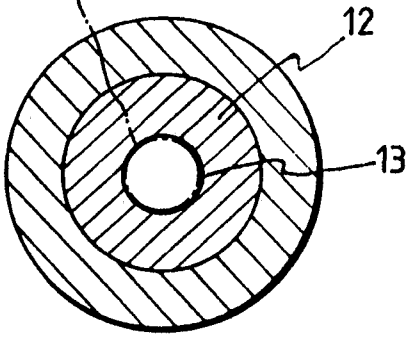
FIG. 4 PRIOR ART
FIG. 4 is a sectional view of a conventional balloon controller taken on line IV—IV in FIG. 3.

FIG. 2 shows a spinning nozzle in a second embodiment according to the present invention. This spinning nozzle is substantially the same in construction as the spinning nozzle in the first embodiment, except that the spinning nozzle in the second embodiment incorporates an improvement to further facilitate the air jetted into the second nozzle 2 flowing out of the second nozzle 2. As shown in FIG. 2, the second nozzle 2 of the spinning nozzle is provided with a balloon controller 12 provided with a through hole 15 having a triangular cross section and expanded corners 16. The size of the balloon of the false-twisted fiber bundle Ya is restricted to that of a circle inscribed in the through hole 15 as indicated by alternate long and short dash line Bc in FIG. 2. The expanded corners 16 enable the air jetted into the second nozzle 2 to flow more smoothly out of the second nozzle 2.

The cross section of the expanded corners 16 need not necessarily be circular as shown in FIG. 2; the expanded corners 16 may be of any suitable cross section, such as a square cross section, provided that only the corners of the through hole 15 are expanded.

In the embodiments mentioned above, the cross section of the through hole 15 is a regular triangle. However, it is not limited to the regular triangle and it may be a polygon such as equilateral triangle, right-angled triangle, square, hexagon and etc. That is the shape of the cross section of the through hole may be essentially that of a passage defined more than three planes with which the yarn ballooning within the passage is contacted.

As is apparent from the foregoing description, the spinning spindle of the present invention comprises first and second nozzles provided with jetting holes through which compressed air is jetted into tubular yarn passages extending along an imaginary center line, and arranged in series coaxially with the imaginary center line, wherein the second nozzle is provided in its outlet end with a balloon controller having a through hole having substantially a triangular cross section. Thus, the size of the balloon of the yarn is restricted to that of a circle inscribed in the through hole of the balloon controller, so that twists inserted in the yarn in the second nozzle propagate stably to a portion of the yarn in the first nozzle. Portions of the through hole of the balloon controller near the corners of the same enable the air jetted into the second nozzle to flow smoothly out of the second nozzle.

What is claimed is:

1. A spinning nozzle, comprising:

a first nozzle defining a substantially tubular yarn passage and provided with a jetting hole through which compressed air is jetted into the yarn passage, a second nozzle defining a substantially tubular yarn passage and provided with a jetting hole through which compressed air is jetted into the yarn passage, the first and second nozzles defining a yarn running direction and the first nozzle being located upstream of the second nozzle in the yarn running direction, the second nozzle defining an outlet end, and a balloon controller provided at the outlet end of the second nozzle, the balloon controller defining a through hole having a substantially triangular cross section.

2. The spinning nozzle of claim 1, wherein the cross section of the through hole defines a substantially triangular shape having three corners and wherein each of the three corners has an expanded cross section.

3. The spinning nozzle of claim 2, wherein the expanded cross section of each of the three corners defines a substantially circular shape.

* * * * *